US008651288B2

(12) United States Patent
Squitieri

(10) Patent No.: US 8,651,288 B2
(45) Date of Patent: Feb. 18, 2014

(54) SHELF AND MERCHANDISE DISPLAY SYSTEM

(75) Inventor: Anthony C. Squitieri, Monroe, CT (US)

(73) Assignee: Mechtronics Corporation, White Plains, NY (US)

( * ) Notice: Subject to any disclaimer, the term of this patent is extended or adjusted under 35 U.S.C. 154(b) by 16 days.

(21) Appl. No.: 12/337,995

(22) Filed: Dec. 18, 2008

(65) Prior Publication Data

US 2009/0159546 A1 Jun. 25, 2009

Related U.S. Application Data

(60) Provisional application No. 61/015,477, filed on Dec. 20, 2007.

(51) Int. Cl.
*A47F 1/00* (2006.01)

(52) U.S. Cl.
USPC ..... 211/59.2; 211/184

(58) Field of Classification Search
USPC ..... 211/59.2, 59.3, 74, 184; 312/35, 42, 45, 312/61, 71; 221/118, 130, 131
See application file for complete search history.

(56) References Cited

U.S. PATENT DOCUMENTS

| | | | | | |
|---|---|---|---|---|---|
| 617,284 | A | * | 1/1899 | Darnes | 221/283 |
| 1,291,420 | A | * | 1/1919 | Cough | 221/131 |
| 1,317,534 | A | * | 9/1919 | Williams | 211/59.2 |
| 1,693,231 | A | * | 11/1928 | Gruber | 312/42 |
| 1,745,784 | A | * | 2/1930 | Davis | 211/182 |
| 2,013,284 | A | * | 9/1935 | Michaud | 211/59.2 |
| 2,769,551 | A | * | 11/1956 | Just | 211/59.2 |
| 2,781,918 | A | * | 2/1957 | Palm, Jr. | 211/128.1 |
| 3,393,808 | A | * | 7/1968 | Chirchill | 211/59.2 |
| 3,574,528 | A | * | 4/1971 | Siano | 422/300 |
| 3,669,277 | A | * | 6/1972 | Beesley, Jr. | 211/59.2 |
| 4,705,175 | A | * | 11/1987 | Howard et al. | 211/59.2 |
| 4,925,038 | A | * | 5/1990 | Gajewski | 211/59.2 |
| 5,284,257 | A | | 2/1994 | Schum | |
| 5,303,844 | A | * | 4/1994 | Muehlberger | 221/1 |
| 5,351,839 | A | * | 10/1994 | Beeler et al. | 211/59.3 |
| 5,353,939 | A | | 10/1994 | Beeler et al. | |
| 5,361,937 | A | * | 11/1994 | Wiese | 221/189 |
| D486,324 | S | * | 2/2004 | Mason | D6/473 |
| D489,556 | S | * | 5/2004 | Mason | D6/511 |
| D496,193 | S | * | 9/2004 | Mason | D6/468 |
| 6,877,618 | B2 | | 4/2005 | Mason | |

(Continued)

OTHER PUBLICATIONS

International Search Report for PCT/US2008/87391, dated Mar. 10, 2009.

*Primary Examiner* — Joshua Rodden
(74) *Attorney, Agent, or Firm* — MKG, LLC

(57) ABSTRACT

A merchandise display system is presented. The display system includes a support frame, a plurality of shelves disposed on the support frame, and a plurality of dividers coupled to each shelf. Each shelf includes a base having a plurality of arcuate surfaces extending continuously as tangent radii from a front end to a rear end of the base. In one embodiment, the arcuate surfaces and the dividers cooperate to define a plurality of lanes. Each lane is dimensioned to accommodate a front to back column of merchandise items. When a merchandise item is placed at the rear end of one of the lanes, the merchandise item traverses the lane by gravity to the forward end of the lane such that the merchandise item is presented to a prospective consumer in a substantially upright and forward facing position.

15 Claims, 4 Drawing Sheets

(56) References Cited

U.S. PATENT DOCUMENTS

| | | | | |
|---|---|---|---|---|
| D511,426 | S * | 11/2005 | Mason | D6/459 |
| 7,083,054 | B2 | 8/2006 | Squitieri | |
| 7,131,543 | B2 * | 11/2006 | Mason | 211/59.2 |
| D537,274 | S * | 2/2007 | Pirro et al. | D6/459 |
| 2004/0195195 | A1 * | 10/2004 | Mason | 211/134 |
| 2004/0211736 | A1 * | 10/2004 | Mason | 211/59.2 |
| 2006/0011565 | A1 * | 1/2006 | Pirro et al. | 211/59.2 |
| 2006/0278591 | A1 | 12/2006 | Tippets et al. | |

* cited by examiner

SHELF AND MERCHANDISE DISPLAY SYSTEM

CROSS-REFERENCE TO RELATED APPLICATIONS

This patent application claims priority benefit under 35 U.S.C. §119(e) of copending, U.S. Provisional Patent Application Ser. No. 61/015,477, filed Dec. 20, 2007, the disclosure of this U.S. patent application is incorporated by reference herein in its entirety.

BACKGROUND OF THE INVENTION

1. Field of the Invention

This invention relates to merchandise and/or product display systems and, in particular, to a merchandise display system having shelves designed to present modular merchandise units to prospective consumers in an improved gravity feed arrangement.

2. Description of Related Art

Consumer merchandise including, for example, batteries, are placed in a primary product package. A number of primary product packages are typically assembled within a modular merchandise unit or box, referred to as a MOD or PDQ, for shipment to a retailer. When received at a retail location, the retailer removes an upper portion of the modular merchandise unit to reveal the consumer merchandise in its primary packaging stored therein. The modular merchandise unit is then directly loaded onto a shelf of a display system that presents the merchandise to a potential consumer within the modular merchandise unit without the need for additional setup. Typically, two or more modular merchandise units are loaded on each shelf in a column arrangement traversing a depth of the shelf from a forward dispensing end to a rear end.

As noted above, the modular merchandise units are typically boxes having a substantially flat bottom surface that rides on the shelves of the display system by gravity feed, as is known in the art. If an angle of incline of each of the shelves is too steep, the modular merchandise units can tilt forward and rotate such that the bottom surface of the modular merchandise units are no longer in contact with the shelf. Such tilt and rotation can result in modular merchandise units jamming within the column, or can result in consumer merchandise not being presented in a preferred manner, e.g., with product information on a front surface of the primary product package clearly visible at the dispensing end of the display device. For example, unwanted rotation of the modular merchandise unit can cause the front of the modular merchandise unit and, thus of the primary product packaging, intended for display to customers to flip over or turn before reaching the dispensing end of the shelf so that a wrong side or rear of the primary product packaging is visible to prospective consumers at the dispensing end.

Prior art display devices have attempted to minimize such adverse tilt and rotation by configuring shelves with lanes or channels, each channel including two spaced apart walls and a floor. The channel provides a moderate incline for merchandise units to travel upon such as, for example, between an about seventeen degree (17°) incline and an about twenty-two degree (22°) or an about twenty-four degree (24°) incline relative to a horizontal shelf. One perceived deficiency in using shelves having only the above described moderate incline is that there is often insufficient gravitational force acting on a last modular merchandising unit in the column of units in a channel such that one or more of the units within the column fails to advance to the correct presentation position at the dispensing end of the shelf.

Accordingly, the inventor has recognized that there is a need for a shelf for a merchandise display system that receives modular merchandise units and that allows the units to descend by gravity from the rear end of the shelf to the front, dispensing end of the shelf in a correct orientation (e.g., substantially upright and forward facing) so that merchandise and product information regarding the merchandise on the primary product packaging is clearly visible to prospective consumers.

SUMMARY OF THE INVENTION

The present invention includes a merchandise display system. The display system includes a support frame, a plurality of shelves disposed on the support frame, and a plurality of divider walls affixed to or removably installable on the shelves. Each shelf includes a base having a plurality of arcuate surfaces. In one embodiment, the base includes a left side wall, a right side wall, a front wall and a rear wall. In one embodiment, the arcuate surfaces, the left side wall, the right side wall and the dividers cooperate to define a plurality of lanes on each shelf. Each lane is dimensioned to accommodate a front to back column of merchandise items. When a merchandise item is placed at a rear portion of one of the lanes, the merchandise item traverse the lane by gravity to a forward portion of the lane such that the merchandise item is presented to a prospective consumer in a substantially upright and forward facing position.

In one aspect of the invention, each of the plurality of arcuate surfaces of the shelves of the merchandise display system is formed as a plurality of surfaces extending continuously as tangent radii from the front end to the rear end of the base. In one embodiment, the merchandise items exhibited on the display system include a plurality of modular merchandise units. Each of the modular merchandise units retains a plurality of primary merchandise packaging for consumer merchandise such as, for example, batteries.

In another aspect of the invention, a gravity-feed shelf for a merchandise display system is provided. The shelf includes a base having a left side wall, a right side wall, and an arcuate upper surface disposed between the left side wall and the right side wall to define a lane. The lane is dimensioned to accommodate a front to back column of merchandise items. When a merchandise item is placed at a rear portion of the lane, the merchandise item traverse the lane by gravity to a forward portion of the lane such that the merchandise item is presented to a prospective consumer in a substantially upright and forward facing position.

BRIEF DESCRIPTION OF THE DRAWINGS

The features and advantages of the present invention will be better understood when the Detailed Description of the Preferred Embodiments given below is considered in conjunction with the figures provided.

In these figures like structures are assigned like reference numerals, but may not be referenced in the description of all figures.

DETAILED DESCRIPTION OF THE PREFERRED EMBODIMENTS

Figure 1:
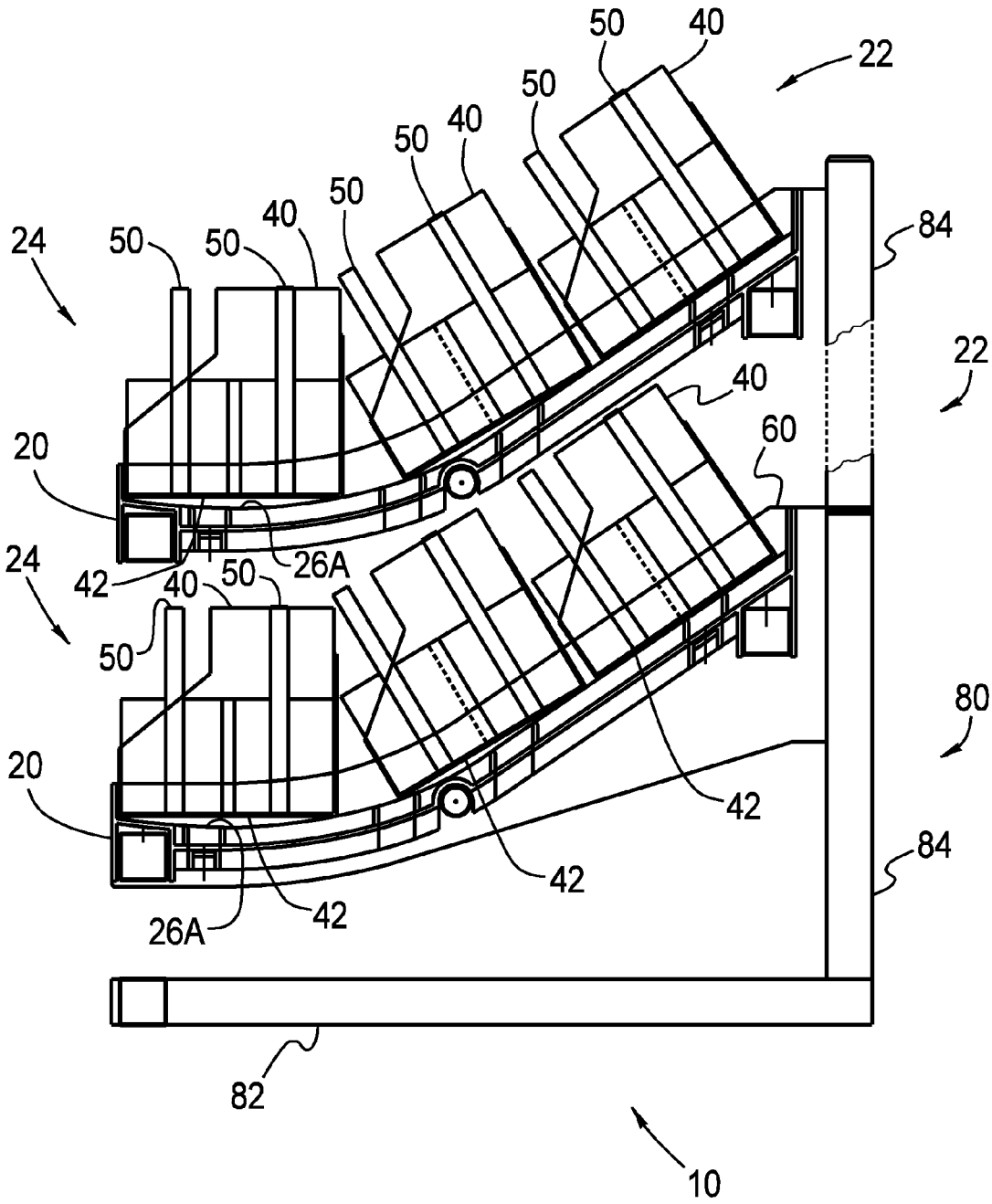
FIG. 1 is a side, partially cross-sectional view of a merchandise display system having shelves presenting modular merchandise units and consumer merchandise stored therein to potential consumers in an improved gravity feed arrangement, in accordance with one embodiment of the present invention.

FIG. 1 illustrates a merchandise display system 10 having a plurality of shelves 20 arranged to receive modular merchandise units 40 and allow the units 40 to descend by gravity from a rear end 22 of the shelves 20 to a front dispensing end 24 of the shelves 20. As shown in FIG. 1, the modular merchandise units 40 retain a plurality of primary product packaging 50 for consumer merchandise such as, for example, batteries and the like. In accordance with the present invention, a base 42 of each of the modular merchandise units 40 traverses the shelves 20 such that the modular merchandise units 40 and the primary product packaging 50 retained therein are presented to prospective consumers at the dispensing end 24 in a substantially upright and forward facing position.

Figure 3:
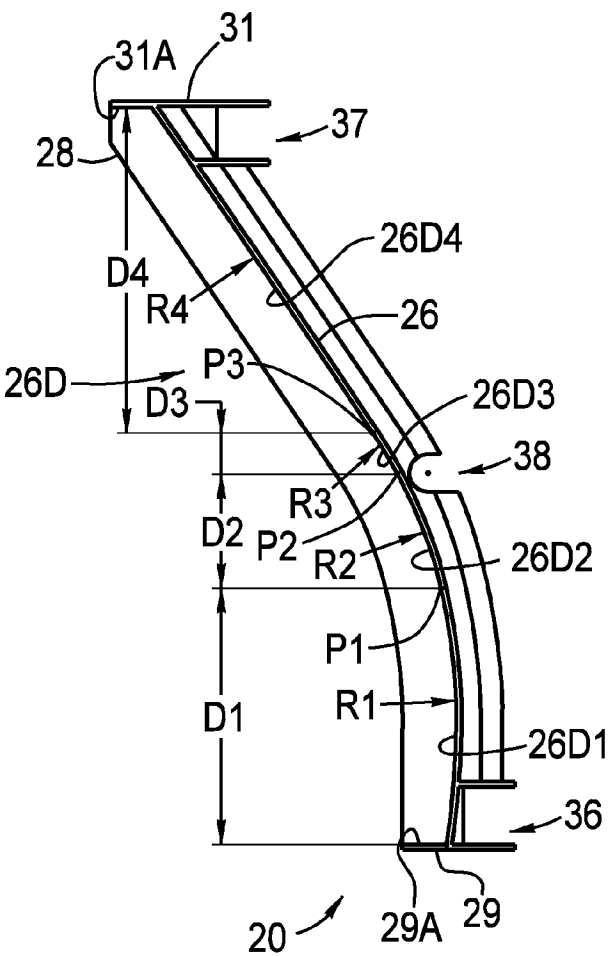
FIG. 3 is a side, cross-sectional view of the shelf of FIG. 2, taken along line 3-3 of FIG. 2.
Figure 2:
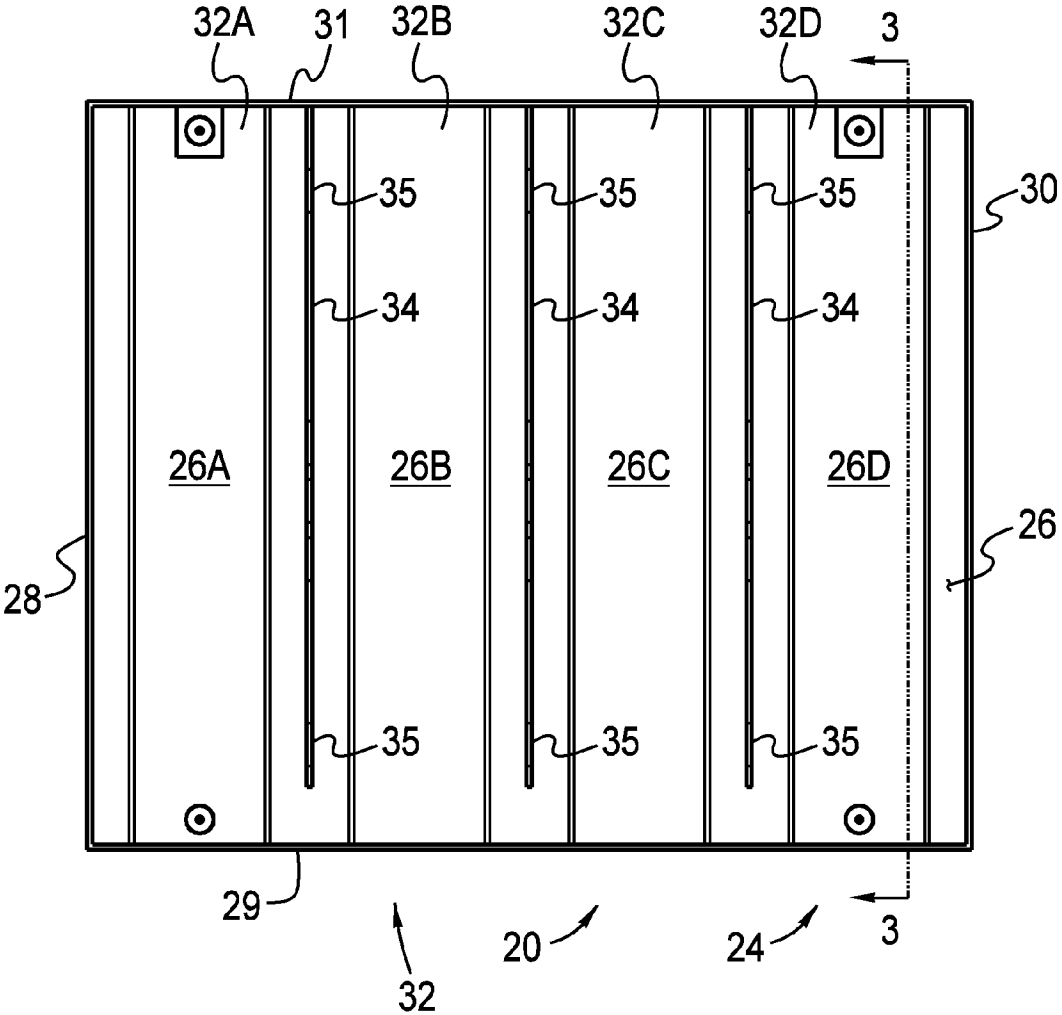
FIG. 2 is a plan view of a shelf as illustrated in FIG. 1, in accordance with one embodiment of the invention.

One embodiment of the shelves 20 is illustrated in FIGS. 2 and 3. As shown, each shelf 20 includes a base 26, a left side wall 28 and a right side wall 30 (left and right are from the perspective of a prospective consumer facing the front, dispensing end 24 of the merchandising display system 10). In one embodiment, the base 26 also includes a front wall 29 and a rear wall 31. The front wall 29 acts as a stop inhibiting the modular merchandise units 40 from being inadvertently discharged from the display system 10 by the weight of and/or pressure applied by subsequent merchandise units 40 in the column of units 40 on the shelf 20. In one embodiment, the base 26, the left side wall 28, the right side wall 30, the front wall 29 and the rear wall 31 are formed as a unitary member such as, for example, a molded plastic assembly comprised of at least one of a medium impact polycarbonate, polypropylene, styrene and like material.

When assembled, the merchandise display system 10 includes a plurality of dividers or wall members 60 (FIGS. 5A and 5B) that are coupled to the base 26 of the shelf 20. In one embodiment, the wall members 60 are removably insertable on the base 26. In another embodiment, the wall members 60 are affixed to the base 26 or integrally formed with the base 26. The base 26 and the wall members 60 cooperate to divide the shelf 20 into a plurality of lanes 32 (FIG. 2) from a left most lane 32A to a right most lane 32D. Each of the lanes 32 has a width and length effective to accommodate an associated front-to-back column of modular merchandise units 40, as illustrated in FIG. 1. In one embodiment, the base 26 includes a plurality of channels 34 configured for receiving, as described below, a corresponding one of the plurality of dividers 60. In one embodiment, the channels 34 are disposed laterally and in a front to back arrangement along the base 26 to define the lanes 32. In one embodiment, the channels 34 include corresponding sets of channels disposed in proximity to each other such that a width of one or more of the lanes 34 may be adjusted (e.g., widened or narrowed) at assembly to accommodate varying width merchandising units 40. For example, by selectively inserting dividers 60 into the sets of channels, the lane 32A may be configured having a lesser width than the width of the lane 32B, and so on for each of the plurality of lanes 32.

As is best shown in FIGS. 2 and 3, the base 26 includes a plurality of arcuate upper surfaces 26A-26D, each surface extending continuously upwardly from the dispensing end 24 to the rear end 22. In one embodiment, the arcuate upper surfaces 26A-26D are each formed as a plurality of surfaces comprised of several tangent radii, e.g., two, three, four, five or more radii with tangents that cooperate to form each of the continuous arcuate upper surfaces 26A-26D. For example, and as illustrated in FIG. 3, the arcuate upper surface 26D includes a plurality of surfaces 26D1, 26D2, 26D3 and 26D4 formed as tangent radii, radii R1-R4. In one embodiment, the surface 26D1 extends the radius R1 from an inside surface 29A of the front wall 29 to a point P1 at a dimension D1 from the inside surface 29A of wall 29, the surface 26D2 extends the radius R2 from the point P1 to a point P2 at a dimension D2 from the point P1, the surface 26D3 extends the radius R3 from the point P2 to a point P3 at a dimension D3 from the point P2, and the surface 26D4 extends the radius R4 from the point P3 to an inner surface 31A of the rear wall 31 at a dimension D4. In one embodiment, the radius R1 is about 13.7 inches (34.8 centimeters (cm)) and the dimension D1 is about 4.4 inches (11.2 cm), the radius R2 is about 8.3 inches (21.1 cm) and the dimension D2 is about 2.7 inches (6.9 cm), the radius R3 is about 20.2 inches (51.3 cm) and the dimension D3 is about 0.8 inch (2.0 cm), and the radius R4 is about 65.38 inches (166.1 cm) and the dimension D4 is about 6.6 inches (16.8 cm). It should be appreciated that it is within the scope of the present invention to vary the radii R1-R4 and dimensions D1-D4 to improve the operative flow of the modular merchandise units 40 by gravity feed from the rear end 22 to the dispensing end 24.

In view thereof, each of the lanes 32A-32D is comprised of, proceeding from left to right, an interior of the left side wall 28, the adjacent arcuate upper surface 26A of the base 26, and a left portion of a first divider wall 60 disposed within one of the channels 34 of the base 26 (lane 32A), a right portion of the first divider wall 60, the next adjacent arcuate upper arcuate surface 26B of the base 26, and a left portion of a second divider wall 60 disposed within one of the channels 34 (lane 32B), a right portion of the second divider wall 60, the next adjacent arcuate upper surface 26C of the base 26, and a left portion of a third divider wall 60 disposed within one of the channels 34 (lane 32C), a right portion of the third divider wall 60, the next adjacent arcuate upper surface 26D of the base 26, and an interior portion of the right side wall 30 (lane 32D).

It should be appreciated that the weight of modular merchandise units 40 within the column of units 40 on the shelves 20 and the plurality of arcuate upper surfaces 26A-26D cooperate to provide an improved gravity feed for presenting modular merchandise units 40 and the primary product packaging 50 included therein to prospective consumers in a substantially upright and forward facing position.

Figure 4C:
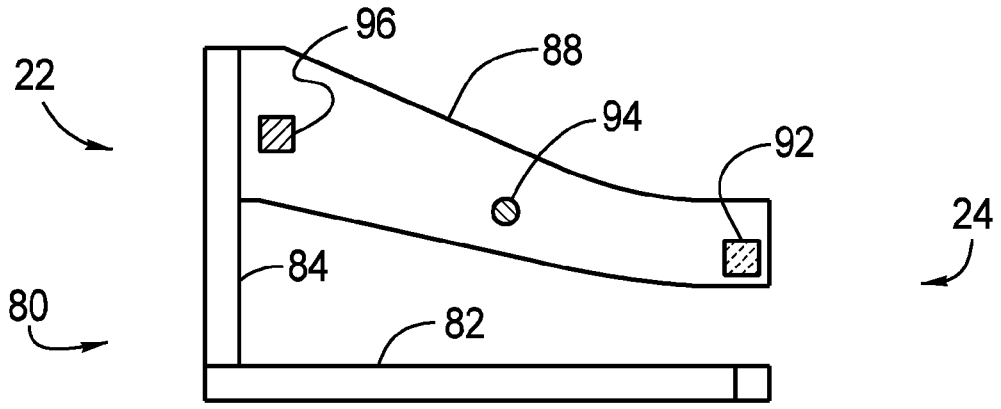
FIG. 4C is a side, partially cross sectional view of the support frame of FIG. 4A, taken along line 4C-4C of FIG. 4A.
Figure 4A:
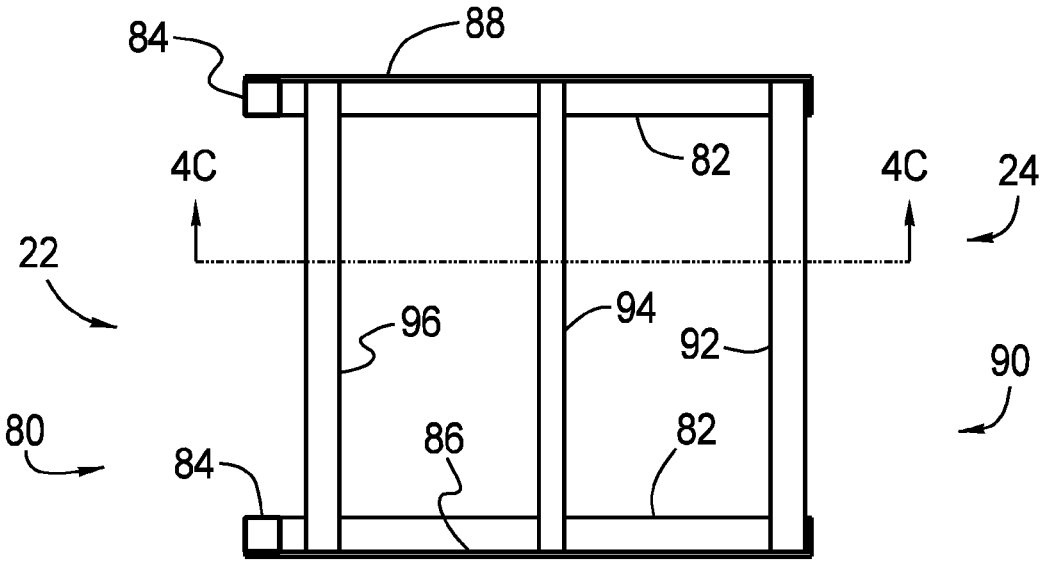
FIG. 4A is a plan view of a support frame, in accordance with one embodiment of the present invention, for supporting shelves of the merchandise display system.
Figure 4B:
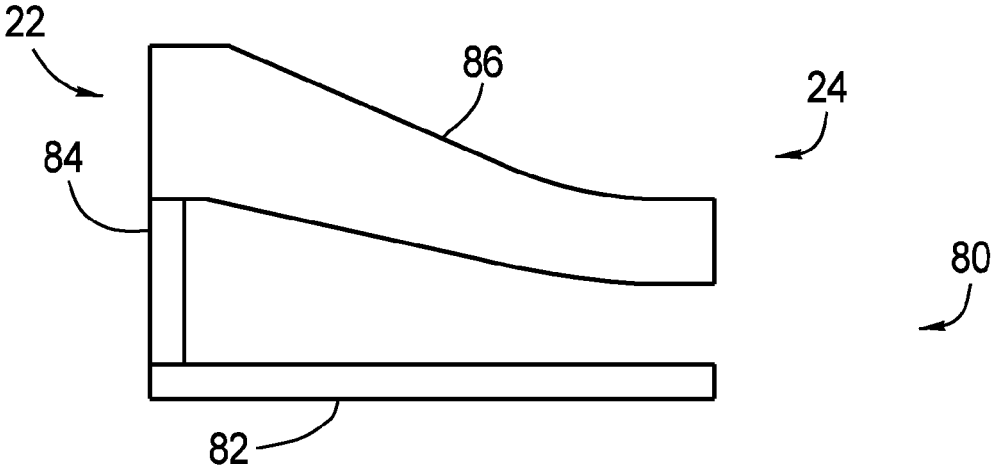
FIG. 4B is a side, elevational view of the support frame of FIG. 4A.

As shown in FIGS. 1 and 4A-4C, the merchandise display system 10 includes a support frame 80. In one embodiment, the support frame 80 is comprised of a base portion 82, an upright portion 84, a left side wall 86 and a right side wall 88 (left and right are from the perspective of a prospective consumer facing the front of the merchandising display system 10). In one embodiment, a plurality of support arms 90 traverse from the left side wall 86 to the right side wall 88 to support the base 26 of a corresponding one of the shelves 20. In one embodiment, illustrated in FIGS. 4A-4C, the support arms 90 include a first tubular arm 92 (e.g., a tubular arm having a square cross section) disposed in proximity to the dispensing end 24 of the merchandise display system 10, a second tubular arm 96 (e.g., a tubular arm having a square cross section) disposed in proximity to the loading end 22 of the system 10, and a support rod 94 disposed between the first tubular arm 92 and the second tubular arm 96. In one embodiment, a lower surface of each of the plurality of shelves 20 includes features for receiving the support arms 90. For example, and with reference to FIGS. 1, 3 and 4A, a forward receiving portion 36 and a rear receiving portion 37 of the shelves 20 are suitably sized to accept the first tubular arm 92 and the second tubular arm 96, respectively. A central receiving portion 38 of the shelves 20 is suitably sized to accept the support rod 94. As can be appreciated, the support arms 90 and the receiving portions 36, 37 and 38 cooperate to retain each of the shelves 20 within the support frame 80 of the merchandise display system 10. It should also be appreciated that other support means may secure the shelves 20 within the support frame 80. For example, the support arms 90 may be of various configurations such as square or round tubes or rods, and the like. Additionally, it is within the scope of the present invention for the shelves 20 to independently support themselves between the left side wall 86 and the right side wall 88. While the display system 10 is shown in FIGS. 4A-4C as including only one shelf 20 supported by the support frame 80, a plurality of shelves 20 may be supported by the support frame in, for example, a vertically stacked arrangement. In one embodiment, lower shelves 20 extends a greater distance from the upright portion 84 then a next vertically higher shelf 20 to form an offset stacked or tiered arrangement of shelves generally referred to as a water fall type arrangement of shelves.

Figure 5B:
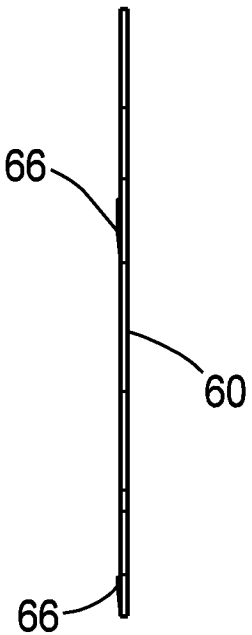
FIG. 5B is a rear elevational view of the divider of FIG. 5A.
Figure 5A:
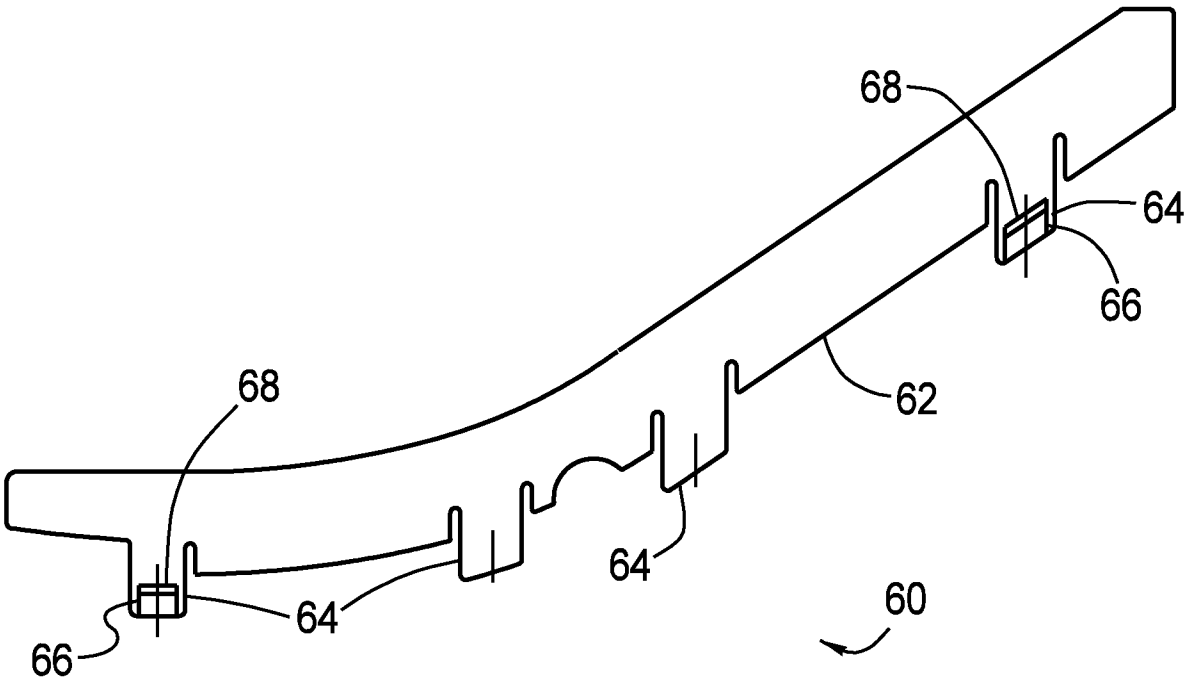
FIG. 5A is a side, elevational view of a divider, in accordance with one embodiment of the present invention, for partitioning the shelf of FIG. 2 into a plurality of channels.

In one embodiment, as shown in FIGS. 5A and 5B, each of the plurality of divider walls 60 is preferably arcuate and formed as a plurality of the radii comparable to the aforementioned radii R1-R4 that comprise the arcuate upper surfaces 26A-26D of the base 26. In this manner, a bottom surface of the divider walls follows the contour of the base 26 as the base 26 extends continuously upwardly from the dispensing end 24 to the rear end 22. In one embodiment, illustrated in FIGS. 5A and 5B, each of the divider walls 60 includes a bottom surface 62 and a plurality of projections 64 extending downwardly from the bottom surface 62. One or more of the projections 64 include fingers 66. In one embodiment, the divider walls 60 are suitably sized to be received by the channels 34 of the base 26 such that the projections 64 pass into slots 35 formed within the channels 34. The fingers 66 have an upper surface 68 advantageously securing or locking the divider walls 60 within the slots 35 of the channels 34. In one embodiment, the divider walls 60 are of a suitable height for preventing the modular merchandise units 40 from toppling over a divider from one lane to another (e.g., from lane 32A to 32B) as the modular merchandise units 40 traverse from the rear end 22 to the dispensing end 24. The inventor has also found that the divider walls 60 acts as rails countering skewing forces caused by the gravity-feed action as the modular merchandise units 40 traverse the upper surfaces 26A-26D of the base 26 from the rear end 22 to the dispensing end 24 of the merchandising system 10. As noted above, it is within the scope of the present invention for the divider walls 60 to be integrally formed within the base 26, or affixed thereto.

It should be appreciated that while each column of modular merchandise units 40 on the shelves 20 are shown in FIG. 1 as including three merchandise units 40 it is within the scope of the present invention for each of the shelves 20 to accommodate more than the three illustrated units 40. For example, it is within the scope of the present invention to extend the rearmost surface 26D4 having radius R4 beyond the dimension D4 and, more appropriately, extend the upper surfaces 26A-26D of the base 26 to accommodate additional modular merchandise units 40 within each column of units. Moreover, while the merchandise display system 10 is illustrated as including a front, dispensing end 24 and a rear end 22, it is within the scope of the present invention for modular merchandise units 40 to be loaded from either the front dispensing end 24 of the shelves 20 or from the rear end 22 of the shelves 20.

It should also be appreciated that while described as a merchandise display system for providing and exhibiting consumer merchandise within modular merchandise units to prospective consumers by an improved gravity feed arrangement, it is within the scope of the present invention to provide and exhibit consumer merchandise directly to consumers by means of the improved gravity feed arrangement. For example, the present invention is not limited to gravity feeding modular merchandise units and, thus, is operative for displaying consumer merchandise in its primary product packaging 50.

Although the invention has been described with reference to particular embodiments thereof, it should be understood by one of ordinary skill in the art, upon a reading and understanding of the foregoing disclosure that numerous variations and alterations to the disclosed embodiments will fall within the spirit and scope of this invention and of the appended claims.

What is claimed is:

1. A gravity-feed shelf of a merchandise display system, the shelf comprising:

a base having a front dispensing end, a rear end, and an arcuate upper surface formed as a plurality of surfaces extending continuously as tangent radii from the front dispensing end to the rear end to define a lane, a first of the plurality of surfaces extends from a point on an inside surface of the front dispensing end to a first point positioned on the arcuate upper surface and has a first curvature defined by a constant first radius R1, the first surface curves both upwardly toward the front dispensing end and upwardly toward the rear end, a second of the plurality of surfaces disposed adjacent to the first of the plurality of surfaces extends from the first point to a second point positioned on the arcuate upper surface and has a second curvature defined by a constant second radius R2 where R2 does not equal R1, a third of the plurality of surfaces disposed adjacent to the second of the plurality of surfaces extends from the second point to a third point positioned on the arcuate surface and has a third curvature defined by a constant third radius R3 where R3 does not equal R2 or R1, a fourth of the plurality of surfaces disposed adjacent to the third of the plurality of surfaces extends from the third point to a fourth point positioned on the arcuate surface and has a fourth curvature defined by a constant fourth radius R4 where R4 does not equal R3, R2 or R1, the lane is dimensioned to accommodate a front to back column of merchandise items; and when a merchandise item is placed at the rear end of the lane, the merchandise item traverses the lane by gravity to the front dispensing end of the lane such that the merchandise item is presented to in a substantially upright and forward facing position.

2. The gravity-feed shelf of claim 1, wherein the merchandise items include a plurality of modular merchandise units, and each of the modular merchandise units retain a plurality of primary merchandise packaging.

3. The gravity-feed shelf of claim 1, wherein the base further includes a left side wall and a right side wall integrally formed therewith.

4. The gravity-feed shelf of claim 3, further including:

a plurality of divider walls removably installable on the base;

the arcuate upper surface, the left side wall, the right side wall and the divider walls cooperate to partition the lane into a plurality of individual lanes, and each of the plurality of individual lanes are dimensioned to accommodate a front to back column of the merchandise items.

5. The gravity-feed shelf of claim 4, wherein the base includes a plurality of channels for receiving and securing at least a portion of the divider walls to the base.

6. The gravity-feed shelf of claim 5, wherein the channels are disposed laterally and in a front to back arrangement along the base to define widths of the individual lanes, and the channels include at least one set of channels disposed in proximity to each other at one of the individual lanes such that a width of the one of the individual lanes is selectively widened and narrowed to accommodate varying width ones of the merchandising items.

7. The gravity-feed shelf of claim 1, wherein a plurality of divider walls are integrally formed with the base.

8. The gravity feed shelf of claim 1, wherein the first radius R1 has a radius of curvature of about 34.8 cm.

9. The gravity feed shelf of claim 8, wherein the first point positioned on the arcuate upper surface is located a distance of about 11.2 cm measured perpendicularly from the inside surface to a first line parallel to the inside surface and intersecting the first point.

10. The gravity feed shelf of claim 9, wherein the second radius R2 has a radius of curvature of about 21.1 cm.

11. The gravity feed shelf of claim 10, wherein the second point positioned on the arcuate upper surface is located a distance of about 6.9 cm measured from the first line to a second line parallel to the first line and intersecting the second point.

12. The gravity feed shelf of claim 11, wherein the third radius R3 has a radius of curvature of about 51.3 cm.

13. The gravity feed shelf of claim 12, wherein the third point positioned on the arcuate surface is located a distance of about 2.0 cm measured from the second line to a third line parallel to the second line and intersecting the third point.

14. The gravity feed shelf of claim 1 wherein the fourth radius R4 has a radius of curvature of about 166.1 cm.

15. The gravity feed shelf of claim 13, wherein the fourth point positioned on the arcuate surface is located a distance of about 16.8 cm measured perpendicularly from the third line to a fourth line parallel to the third line and intersecting the fourth point.

* * * * *